US005558054A

United States Patent [19]

Ariga et al.

[11] Patent Number: 5,558,054

[45] Date of Patent: Sep. 24, 1996

[54] VARIABLE PRELOAD SYSTEM FOR VALVE SPRINGS

[75] Inventors: Susumu Ariga; Jongmin Lee, both of San Antonio, Tex.

[73] Assignee: Southwest Research Institute, San Antonio, Tex.

[21] Appl. No.: 487,036

[22] Filed: Jun. 7, 1995

[51] Int. Cl.[6] ..... F01L 3/10; F01L 1/02

[52] U.S. Cl. ..... 123/90.65; 123/90.67; 123/188.17

[58] Field of Search ..... 123/90.65, 90.66, 123/90.67, 188.13, 188.17; 251/337

[56] References Cited

U.S. PATENT DOCUMENTS

| | | | |
|---|---|---|---|
| 4,312,494 | 1/1982 | Aoyama | 251/48 |
| 4,446,825 | 5/1984 | Giardini et al. | 123/90.65 |
| 4,559,909 | 12/1985 | Honda et al. | 123/90.67 |
| 5,203,535 | 4/1993 | Richeson et al. | 251/48 |
| 5,233,951 | 8/1993 | Hausknecht | 123/90.12 |

FOREIGN PATENT DOCUMENTS

| | | | |
|---|---|---|---|
| 0471614A1 | 2/1992 | European Pat. Off. . | |
| 3525626A1 | 3/1986 | Germany . | |
| 4129637 | 3/1993 | Germany | 123/188.17 |
| 57-13207 | 1/1982 | Japan | 123/188.17 |
| 58-217711A | 12/1983 | Japan . | |
| 58-220910A | 12/1983 | Japan . | |
| 61-255203A | 11/1986 | Japan . | |

*Primary Examiner*—Weilun Lo
*Attorney, Agent, or Firm*—Jenkens & Gilchrist

[57] ABSTRACT

A valve system for use in internal combustion engines includes a means for controllably varying the preload force imposed on a valve spring in correlation with engine speed. At low engine speeds the preload force is maintained at a minimal level whereby the normal load at the cam/follower interface is maintained at a minimal value. At higher engine speeds, the preload force on the valve spring is selectively increased to assure positive closure of the valve head. The increased preload forces are imposed by extending a hydraulically actuated, moveable spring seating surface whereby the installed length of the spring is shortened. The hydraulic actuating fluid is continuously circulated through inlet and outlet ports, communicating with an expandable chamber associated with the moveable seating surface, during low engine speed operation to abate the problem of temperature rise in static fluid systems.

3 Claims, 1 Drawing Sheet

VARIABLE PRELOAD SYSTEM FOR VALVE SPRINGS

TECHNICAL FIELD

This invention relates generally to a system for imposing a controllably variable preload on a valve spring, and more particularly to such a system using a hydraulic lifter to vary the maximum operational length of the spring.

BACKGROUND ART

Engine valves in internal combustion engines are commonly biased toward a closed position by a compressed spring. The bias force provided by the compressed spring when it is at its maximum operational, or installed, length is referred to as "preload", and designated herein by the symbol, $N_o$. The magnitude of the preload force $N_o$ is determined by the amount of initial deflection $\delta$ of the spring multiplied by its compliance coefficient k. This relationship is represented mathematically by the formula: $N_o = k\delta$. It should be noted that the compliance coefficient k of a spring element is often interchangeably identified by several terms, such as spring rate, spring constant, or compliance rate. The preload force $N_o$ should be of a magnitude sufficient to assure that the valve head is securely maintained on its seat during the closing period. The force required to assure seating of the head at high engine speeds is higher than that required at relatively low engine speed and, therefore it is customary to compress the valve springs upon installation in an engine, by an amount sufficient to provide the higher preload force. The total bias force N imposed by the spring on the valve varies over time during the opening and closing cycle of the valve head, and is the sum of the preload $N_o$ and the additional deflection $\delta$ of the spring at a specific instant in the cycle, times its constant k. That is, $N=k\delta+N_o$, with N being a force acting in a direction along the line of movement of the valve and normal, or perpendicular to the interface between the cam or follower and the push rod or linkage surfaces associated with the valve.

The boundary friction force F at the cam/follower interface is the principal parameter determining wear on the respective components comprising the interface. The boundary friction force F is in the mixed lubrication regime and is equal to the friction coefficient $\mu$ times the normal load N, i.e., $F=\mu N$. At the cam/follower interface, the friction coefficient $\mu$ is a strong function of the normal load N, such that a small reduction in the normal load significantly decreases the friction coefficient $\mu$. Thus, reductions in the normal load N have a double impact on the boundary friction force F and, in that the preload $N_o$ constitutes one component of the normal load N, it is desirable to reduce the preload $N_o$ force when the engine is operating a lower speeds. Importantly, reduction in the preload $N_o$ at lower engine operating speeds increases the engine operating efficiency and reduces fuel consumption at those speeds.

Several systems have been proposed by which a variable preload is imposed on engine valves. For example, U.S. Pat. No. 4,446,825 issued May 8, 1984 to Dante S. Giardini et al describes an engine valve system in which a fixed preload is imposed on the valve spring during operation of the engine at higher speeds. The fixed preload is applied by a piston in communication with a hydraulic chamber that can be selectively pressurized or emptied through a single port in the chamber. Fluid trapped in the chamber is thus subjected to heat buildup during extended high speed operation of the engine as a result of direct heat transfer and the conversion of absorbed mechanical energy to heat. Without recirculation or other means for the transfer of heat from the fluid trapped in the hydraulic chamber, the fluid may absorb sufficient heat to raise the fluid to a temperature above its vapor point, causing concurrent increases in the chamber pressure and volume. This event is advantageously used to affect changes in the length of self-adjusting hydraulic tappets. However, in a spring preload system, the increase in chamber volume adds unintended preload forces on the spring that impose excessive, unnecessary and undesirable forces on the valve train, increasing wear and decreasing engine efficiency.

Also, Japanese published examined application 58-217711 to Kaoru Katayama discloses a valve spring system having two springs, one inside the other, acting in parallel. A preload is selectively applied on the inner spring when the engine is operating in a high speed range by a moveable hydraulic piston similar to that proposed by Giardini et at. The Katayama valve device has the same inherent problems with respect to fluid temperature build up and absence of fluid circulation fluid through the chamber controlling the position of the piston.

Another Japanese published examined application, 61-255203 to Takeo Fuwa, describes a closed system having a fluid path between two valves in which chambers controlling the position of hydraulic lifters are interconnected. Fluid within the system is confined to the two chambers and their interconnecting passageway such that a reduction in the volume of one chamber results in a corresponding increase in the volume of the other chamber. The Fuwa valve device also has inherent problems with respect to fluid temperature build up attributable to the absence of circulating fluid through the piston actuating chamber.

The present invention is directed to overcoming the problems set forth above. It is desirable to have an engine valve system in which a variable preload can be controllably imposed to reduce friction forces at critical interfaces in the valve train during low speed operation of the engine. Further, it is desirable that fluid employed in the actuation of the variable preload system be recirculatable to alleviate undesirable excessive temperature increases in the actuating fluid. It is also desirable to have such a system in which the stiffness of the valve spring varies in response to variations in the rotational speed of the engine.

DISCLOSURE OF THE INVENTION

In accordance with one aspect of the present invention, a valve spring variable preload system for an internal combustion engine has a spring positioned between a retainer associated with a valve, and a moveable seating surface. The seating surface is moveable between retracted and extended positions. The valve spring is compressed to an initial installed length when the moveable seating surface is at its retracted position, and further compressed to a shorter maximum length when the moveable seating surface is at its extended position. The moveable seating surface is formed on an exterior surface of a hydraulic lifter that has interior walls defining a portion of an expandable chamber. The expandable chamber has both an inlet and an outlet port communicating respectively with a source of pressurized fluid and a fluid drain. A means for controlling the flow of fluid through the chamber provides substantially unrestricted fluid flow through the chamber when the engine speed is less than a predetermined value, and restricts the flow of fluid through the chamber when the speed of the engine is greater than the predetermined value.

In another aspect of the present invention, the variable valve spring preload system includes a spring having a compliance coefficient that increases in response to increased deflection of the spring.

BEST MODE FOR CARRYING OUT THE INVENTION

The variable valve spring preload system embodying the present invention is applicable to internal combustion engines having at least one combustion chamber, with inlet and exhaust passageways between the combustion chamber and respective intake or exhaust manifolds. Each of the combustion chambers have two or more valves associated with the chamber for controlling the flow of air, air-fuel mixtures, or the products of combustion, to and from the chamber.

Figure 1:
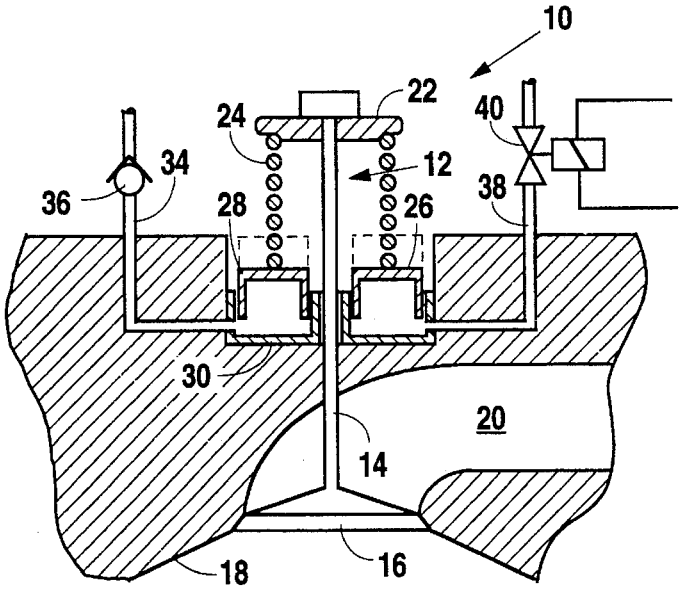
FIG. 1 is a simplified sectional view of the valve system embodying the present invention, with conventional elements represented schematically.

In the preferred embodiment of the present invention, shown in FIG. 1, the variable preload system 10 for an engine valve includes a valve 12 having an elongated stem 14 with a head 16 formed at a first end of the stem 14. The head 16 is moveable between open and closed positions with respect to a combustion chamber 18 and an inlet or exhaust passageway 20 disposed within the engine. A spring retainer 22 is removably attached to a second end of the stem 14 in a conventional manner whereby the valve 12 and the spring retainer 22 move as a unit. Thus, when the valve 12 is moved in a downward direction by the lobe of an overhead cam, a rocker arm, or other mechanical or electrical device, not shown, the valve head 16 is moved downwardly to an open position, and the spring retainer 22 is simultaneously moved in the same downward direction.

A spring 24 is positioned between the spring retainer 22 and a moveable seating surface 26 associated with the valve 12. The spring 24 is initially compressed at the time of installation such that installed length of the spring 24 is less than its free length. In operation, downward movement of the spring retainer 22, as viewed in FIG. 1, further compresses the spring 24. Desirably, the spring 24 may have a variable spring constant, or compliance rate k, such as that provided by a conical spring, in which the compliance coefficient k increases with corresponding increases in the deflection, or compression, of the spring 24. By the use of a variable rate spring 24, the preload system 10 embodying the present invention will not only have a controllably variable preload, as described below, but also provide a valve system in which the spring rate, or stiffness, k increases in response to operational deflection of the spring 24 during opening of the valve 12.

The moveable seating surface 26 of the valve preload system 10 embodying the present invention is the upper surface of an annularly shaped hydraulic piston, or lifter, 28 that cooperates with a cup-shaped liner 30 disposed in flat bottomed bore to form an expandable chamber 32 surrounding the valve stem 14. An inlet port 34 extends between the chamber 32 and a source of pressurized fluid, preferably engine oil provided by a conventional oil pump in the engine. A portion of the inlet port 34 may be conveniently formed as an internal passage within the engine, as illustrated in FIG. 1. Importantly, a reverse flow check valve 36 is positioned in the inlet port 34 between the chamber 32 and the fluid source, to prevent a reverse flow of fluid from the chamber 32.

In a similar manner, an outlet port 38 extends from the chamber 40 to a drain reservoir, such as an engine oil pan, not shown. Fluid flow from the chamber 32 is regulated by a solenoid actuated flow control valve 40 interposed on the outlet side of the chamber 32 between the outlet port 38 and the drain. When the flow control valve 40 is open, there is a substantially unrestricted flow of fluid, e.g., engine oil, through the chamber 32, and the spring lifter 28 is at a retracted position.

When the flow of fluid from the chamber 32 is prevented by closure of the flow control valve 40, pressure in the chamber 32 increases to that of the pressurized fluid, chamber volume is expanded, and the hydraulic lifter 28 is moved upwardly to the position indicated by the dashed lines in FIG. 1. At the elevated position, the spring 24 is additionally compressed to a shorter operating length as a result of moving the seating surface 26 toward the retainer 22.

The solenoid operated flow control valve 40 has an orifice that is moved between open and closed positions in correlation with engine speed. Engine speed is routinely sensed by a sensor, such as a crankshaft position monitor or engine tachometer, which is used as an input signal 42 to a conventional onboard electronic control unit (ECU) 44. Programmable, as well as ROM, ECUs are well known in the automotive arts and are commonly used to control transmission shift points, engine timing, engine valve operation, chassis suspension settings, and any one or more of other engine and vehicle operational parameters. An output signal 46, correlative of engine speed is provided by the ECU 44 and delivered to the solenoid operated flow control valve 40 which, in turn, controls the position of the valve orifice.

Figure 3:
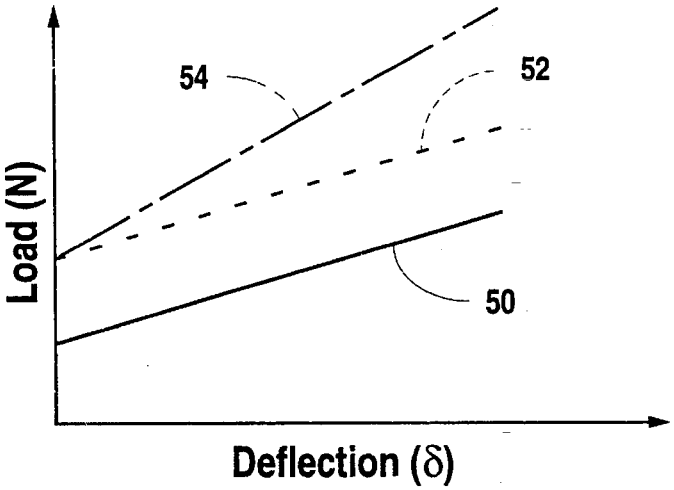
FIG. 3 is a graph showing the relationship between normal load and spring deflection provided by the valve system embodying the present invention.

The value of the control signal 46 from the ECU 44 will have a minimum value when the engine speed is less than a predetermined value, for example 1000 rpm. At the minimum value, the solenoid controlled flow control valve 40 is open, the flow of fluid through the chamber 40 is essentially unrestricted, the spring seating surface 26 is at its retracted position, and the preload force $N_o$ imposed on the spring 24 has an initial, relatively low value. This value is represented in FIG. 3 by the intercept of the solid line 50 with the Y axis representing the normal load N. As explained above, the normal load N imposed on the respective components at the cam/follower interface is represented by the equation:

$$N = k\delta + N_o$$

The last term in the equation, $N_o$, represents the magnitude, or amount of preload force imposed on the spring at its maximum installed, or operating, length. The slope of the solid line corresponds to the value of the $k\delta$ term in the equation, which is the product of the spring rate k and the deflection $\delta$ of the spring 24. The normal load N increases to a maximum value during each opening of the valve 12.

When engine speed increases to a value greater than the predetermined value, the control signal 46 provided by the ECU 44 will close the flow control valve 40, thereby restricting the flow of fluid from the chamber 32. As a result of restricted flow, the fluid pressure in the chamber 32 increases, moving the seating surface 26 to its extended position whereby the spring 24 is compressed an additional amount. As indicated by the dashed, and alternating long and short dashed lines in FIG. 3, the additional compression increases the preload force $N_o$ as indicated by the higher Y axis intercept of the two lines. The evenly dashed line 52 is representative of a spring 26 having the higher preload force $N_o$ and a uniform spring constant k. The alternating long and short dashed line 54 represents a spring 24, for example a conical spring, having the higher preload force $N_o$ and a spring rate k that increases linearly with a corresponding increase in deflection δ. Other variable rate springs may have a geometrically variable spring rate k, in which instance the slope of a line showing the relationship between normal load N and deflection δ would be nonlinear.

Figure 2:
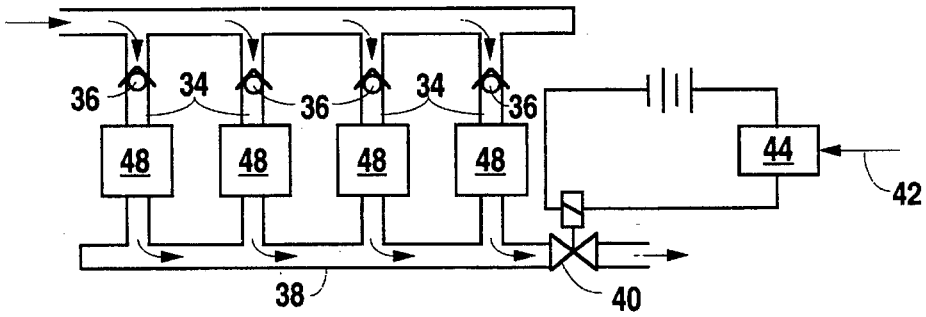
FIG. 2 is a schematic representation of the associated hydraulic and electrical components of the valve system shown in FIG. 1.

FIG. 2 shows a schematic diagram of the fluid supply and drain elements, and the electrical components of the valve system 10 embodying the present invention as applied in a four cylinder engine arrangement. The valve systems 10 for each cylinder, represented by a box 48 in FIG. 2, are supplied with pressurized fluid through the single inlet check valve 36, and thence through individual inlet ports 34 to each valve preload system. The outlet ports 38 of the valves 12 associated with each cylinder 48 are manifolded together so that fluid circulation through all of the separate expandable chambers 32 is controlled by a single solenoid operated flow control valve 40. Accordingly, the preload value $N_o$ of all of the valve springs 24 in the engine are varied simultaneously in response to a variation in engine speed.

Industrial Applicability

The valve system 10 embodying the present invention is particularly applicable to internal combustion engines, whether powered by gasoline, diesel fuel, methanol, ethanol, or other fuel, that operate over a wide range of engine speeds. At low engine speeds, the preload force imposed on the valve springs in the engine have a relatively low value whereby friction forces at the interface of a valve actuating member such as a cam or rocker arm with the follower surface of the valve are minimized, engine efficiency is increased, and fuel consumption is lowered. At higher engine speeds, the preload is increased to assure positive seating of the valve head during the shortened closure period, and thereby provide improved engine operation at the higher speeds.

The variable valve spring preload system 10 embodying the present invention is compact, easily controllable by conventional hydraulic and electrical components. Furthermore, the variable valve spring preload system 10 provides for the beneficial through flow of actuating fluid through inlet and outlet ports communicating with an expandable chamber, thereby ameliorating the problem of temperature rise in the static fluid systems used heretofore to impose preload forces on engine valve springs.

The alternative embodiment of the variable valve spring preload system 10 provides for a variable rate spring so that the system 10 not only provides a variable preload force on the valve spring consistent with varying engine speeds, but also provides an arrangement whereby the spring constant also increases with increasing engine speed.

Other aspects, features and advantages of the present invention can be obtained from a study of this disclosure together with the appended claims.

What is claimed is:

1. A variable valve spring preload system for an internal combustion engine having a plurality of valves movably disposed in said engine, each of said valves having a stem extending between spaced ends, a spring retainer removably attached to the stem at one of said ends, and a spring compressibly interposed said spring retainer and a seating surface concentrically positioned about said valve stem, said seating surface being selectively movable along said stem between a retracted position at which said spring is compressed to a first maximum length and an extended position at which said spring is compressed to a length less than said first maximum compressed length, said variable spring preload system comprising:

a hydraulic lifer having interior walls defining a portion of an expandable chamber and an exterior surface portion defining said spring seating surface;

an inlet port communicating said expandable chamber with a source of pressurized fluid;

an outlet port spaced from said inlet port and communicating said expandable chamber with a drain reservoir; and a means for controlling the flow of fluid through said chamber from said inlet port to said outlet port, said fluid flow being substantially unrestricted in response to the speed of said engine being less than a predetermined value and restricted in response to the speed of said engine being equal to or greater than said predetermined value, said means comprising a fluid flow control valve interposed said outlet port and said drain reservoir, said fluid flow control valve having a variable orifice that is moved to a closed position in response to the speed of said engine being equal to or greater than a predetermined value, and moved to an open position in response to said engine speed being less than said predetermined value.

2. A variable valve spring preload system, as set forth in claim 1, wherein said spring has a compliance coefficient that increases in response to an increase in the deflection of said spring.

3. A variable valve spring preload system, as set forth in claim 1, wherein said system includes a reverse flow check valve interposed said source of pressurized fluid and said inlet port.

* * * * *